US005291245A

United States Patent [19]

Charnitski et al.

[11] Patent Number: 5,291,245

[45] Date of Patent: Mar. 1, 1994

[54] PHOTORECEPTOR BELT SEAM DETECTION AND PROCESS CONTROL

[75] Inventors: George A. Charnitski, Fairport; Steven C. Hart, Webster, both of N.Y.

[73] Assignee: Xerox Corporation, Stamford, Conn.

[21] Appl. No.: 35,869

[22] Filed: Mar. 23, 1993

[51] Int. Cl.[5] ..... G03G 21/00

[52] U.S. Cl. ..... 355/208; 355/203; 355/212

[58] Field of Search ..... 355/211-213, 355/203, 204, 208, 200, 67; 250/548, 559, 200, 571-572; 226/21

[56] References Cited

U.S. PATENT DOCUMENTS

| | | | |
|---|---|---|---|
| 4,657,369 | 4/1987 | Takeuchi | 355/212 |
| 4,660,059 | 4/1987 | O'Brien | 346/157 |
| 4,833,503 | 5/1989 | Snelling | 355/259 |
| 4,847,660 | 7/1989 | Wheatley, Jr. et al. | 355/244 |
| 4,884,106 | 11/1989 | Harris | 355/212 |
| 4,922,305 | 5/1990 | Agarwal | 355/299 |
| 5,101,232 | 3/1992 | Evans et al. | 355/208 |
| 5,173,733 | 12/1992 | Green | 355/208 |
| 5,175,570 | 12/1992 | Haneda et al. | 355/208 X |
| 5,252,991 | 10/1993 | Storlic et al. | 355/203 X |

FOREIGN PATENT DOCUMENTS

| | | | |
|---|---|---|---|
| 0059973 | 3/1987 | Japan . | |
| 0124570 | 6/1987 | Japan | 355/212 |

OTHER PUBLICATIONS

*IBM Technical Disclosure Bulletin*, vol. 9, No. 11, Apr. 1967, "An Electrographic Printer with Asynchronous Image Belt", T. M. Hider and H. C. Medley.

*Primary Examiner*—Matthew S. Smith

[57] ABSTRACT

An apparatus and method for detecting the seam in a photoreceptor belt is provided. A sensor is positioned on one side of the belt in opposed relationship to a light source which can be a lamp dedicated solely to that purpose or light from an imager such as an LED array or a Raster Output Scanner. Illumination from the light source of the end of the array is detected by a sensor when the seam passes therebetween creating a characteristic output signal which is recognized by system software and used to control imager operation to ensure that latent images are not formed across the seam.

4 Claims, 4 Drawing Sheets

PHOTORECEPTOR BELT SEAM DETECTION AND PROCESS CONTROL

DESCRIPTION OF THE INVENTION AND MATERIAL DISCLOSURE STATEMENT

The invention relates generally to an electrophotographic printing machine having a seamed, web-type photoreceptor suitable for the exposure of one or more document latent images on the surface thereof, and, more particularly, to a method and apparatus for detecting the belt seam and for generating a signal useful for process control and machine timing.

The features of the present invention may be used in the printing arts, and, more particularly, in electrophotographic printing. In the process of electrophotographic printing, a photoconductive surface is charged to a substantially uniform potential. The photoconductive surface is then image-wise exposed to record an electrostatic latent image corresponding to the informational areas of an original document being reproduced. Thereafter, a developer material is transported into contact with the electrostatic latent image. Toner particles are attracted from the carrier granules of the developer material onto the latent image. The resultant toner powder image is then transferred from the photoconductive surface to a copy sheet and permanently affixed thereto. The foregoing description generally describes a typical single color electrophotographic copying machine.

For many high speed copier applications a photoreceptor belt is preferred to the photosensitive member. Belts have the capacity to form a plurality of images in a plurality of image frames available on the photoreceptor surface during a single pass or revolution of the belt. As is known in the art, belts are formed by a process which leaves a seam extending across the belt width. The seam presents a discontinuity in the photoreceptor surface. In operation, the photoreceptor belt is moved at a predefined velocity, and the rate of travel of the advancing copy sheet is controlled so as to regulate the exposure and transfer operations in accordance with the position of the advancing sheet. Minor variations in the speed of the belt drive motor, due, for example, to variations in the power line voltage, result in a variation of the position of latent images on the photoreceptor. These variations are cumulative in nature and must be corrected to assure that the latent images are exposed at generally the same positions on the photoreceptor each time. If not corrected, the cumulative variation would eventually cause one or more of the exposed latent image areas to encroach on the photoreceptor seam, subsequently resulting in an unacceptable copy.

A number of techniques have been developed to overcome this problem. A typical solution is to cut a hole into the belt at a predetermined displacement from the belt seam and detect the passage of the hole with a photosensor whose output is then used to control the various xerographic stations and/or the photoreceptor speed so that the latent image is not projected across the belt seam. This type of scan seam hole sensing is disclosed, for example, in U.S. Pat. Nos. 5,101,232 and 4,922,305, whose contents are hereby incorporated by reference.

Alternatively, notches formed in the belt edge at known distances from the belt seam are detected by sensors which generate outputs used for timing and control purposes. See, for example, U.S. Pat. No. 4,847,660.

According to a still further technique and as disclosed in co-pending application, U.S. Ser. No. 07/930,642, filed Aug. 17, 1992, assigned to the same assignee as the present invention and whose contents are hereby incorporated by reference, toner registration marks are formed along the edge of the belt and/or interframe area and are detected by light from LED arrays passing through the belt and falling on dedicated sensor arrays. The detected marks results in sensor signal outputs which are used to compensate for the detected registration deviation of the images formed on the belt.

The first two prior art techniques requires an additional process step in the belt manufacture to form the hole or notch. Further, holes created in the belt produce a stress concentration which weakens the structural integrity of the belt leading to cracking or tearing failures near the hole or aperture.

According to one aspect of the present invention, and in a preferred embodiment of a color copier, light from the ends of a linear light array which is selectively controlled to expose a photoreceptor surface, is used to illuminate the belt seam of the photoreceptor belt passing therebeneath. For systems having light transmissive belts, a detector is located on the opposite side of the belt in optical alignment with the linear array ends. The light detected by the sensor when the seam is illuminated is at a different level from the light sensed through the belt in non-seamed areas. The signal that is generated when a seam is detected is used for the conventional purposes of calibrating machine operation to ensure that images will not be exposed over the seam.

According to a further aspect of the present invention, and in a color system wherein a plurality of color images are sequentially formed on the belt surface, developed and transferred to a copy sheet, a sensor associated with detecting registration holes or marks on the belt is used for the additional purpose of detecting passage of the belt seam.

More particularly, the present invention related to an improved reproduction machine of the type having a light transmissive photoreceptor belt mounted for movement substantially in a predetermined reference direction, said belt having a seam extending across the width thereof, wherein the improvement comprises:

an imager opposed from one surface of the belt for sequentially exposing portions of the belt surface to form an image thereof, and at least one light sensitive sensor opposed from the other surface of the belt for sensing passage of the seam between the imager and the sensor, and for generating an output signal representative of said seam detection.

DESCRIPTION OF THE INVENTION

Figure 1:
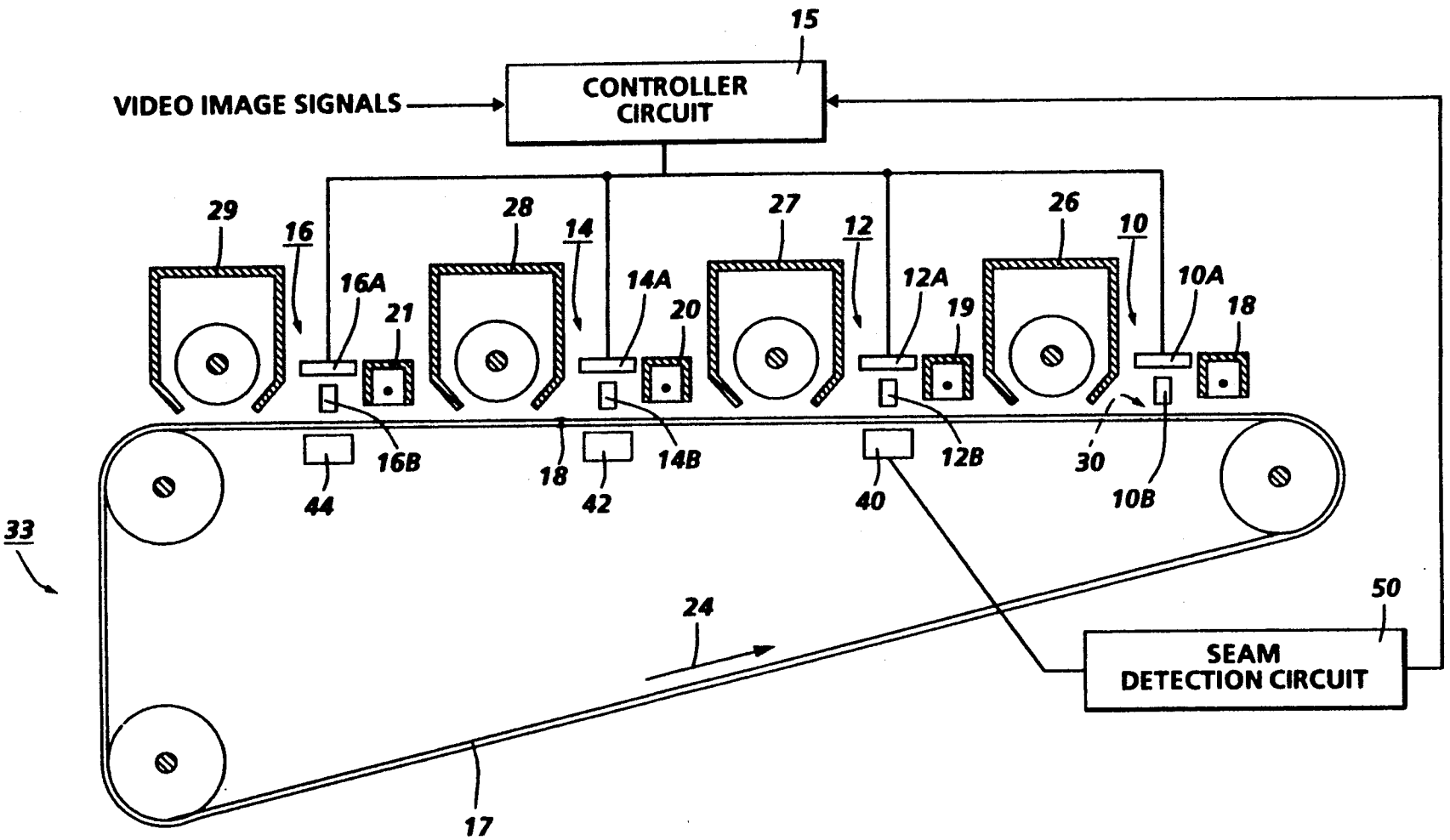
FIG. 1 is a side view of a single pass LED image bar printer incorporating the improved seamed detection circuitry of the present invention.
Figure 2:
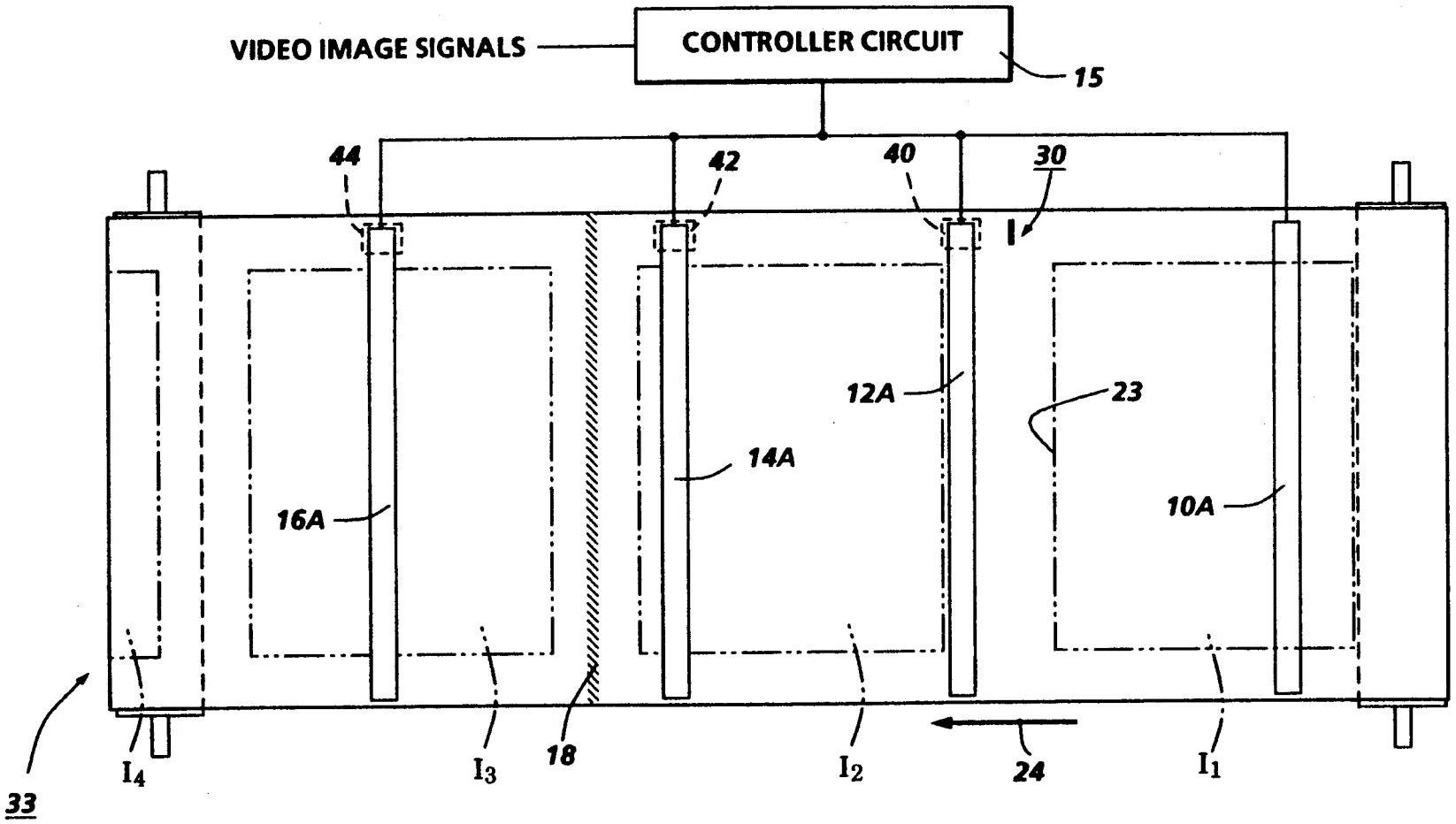
FIG. 2 is a top view of the printer of FIG. 1 omitting the xerographic stations excepting the exposure station.

FIG. 1 shows a printing system having four exposure stations 10, 12, 14, 16, each station including an LED print bar 10A, 12A, 14A, 16A. FIG. 2 shows a top view of the system of FIG. 1, absent some of the xerographic stations, for ease of description. Referring to FIGS. 1 and 2, each print bar is selectively addressed by video image signals processed through controller circuit 15, to produce a modulated output which is coupled through a gradient index lens array 10B, 12B, 14B, 16B, onto the surface of previously charged semi-transparent photoreceptor belt 17. In a preferred embodiment, each print bar consists of a central portion of light emitting pixels which, when selectively activated, form image exposure areas. The print bars also include end portions of light emitting pixels outside of the exposure areas which are activated for print bar registration and seam detection purposes as will be seen.

Photoreceptor belt 17 is formed by a process resulting in a seam 18 extending across the width thereof. Belt 10 is semi-transparent and, preferably, is made from a photoconductive material coated on a ground layer, which, in turn, is coated on anti-curl backing layer. The photoconductive material is made from a transport layer coated on a generator layer. The interface layer is coated on the ground layer. The transport layer contains small molecules of di-m-tolydiphenyldiphenylbithenyldiamine dispersed in a polycarbonate. The generation layer is made from trigonal selenium. The grounding layer is made from a titanium coated MYLAR. The ground layer is very thin and allows a portion of the incident light to pass therethrough. Other suitable photoconductive materials, ground layers, and anti-curl backing layers may also be employed. Belt 17 moves in the direction of arrow 24 to advance successive portions of the photoconductive surface sequentially through the various processing stations (not shown) disposed about the path of movement thereof.

The video image signals to the print bar may be computer generated color images or digital signals representing a document which has been scanned with a conventional RIS scanner. Exposure stations 12A, 14A, 16A also include sensor circuits 40, 42, 44, for purposes described below. The length of belt 17 is designed to accept an integral number of full page image frames; e.g. $l_1$–$l_4$, represented by dashed lines. Upstream of each exposure station are charge devices 18, 19, 20, 21, (FIG. 1) which place a predetermined electrical charge on the surface of belt 17. As the belt moves in the direction of arrow 24, each image frame moves past each of the print bars, with each bar providing its own exposure pattern, in response to the video image signal input. The exposure pattern begins when the leading edge of an image frame reaches a transverse start-of-exposure line, represented in image frame $l_1$ by a line 23. The exposure pattern is formed of a plurality of closely spaced transverse scan lines. Downstream from each exposure station, a development system 26, 27, 28, 29, develops a latent image of the last exposure without disturbing previously developed images, a fully developed color image is then transferred at transfer station 33, by means not shown, to an output sheet. Further details of the operation of xerographic stations in a multiple exposure single pass system are disclosed in U.S. Pat. Nos. 4,660,059 and 4,833,503, whose contents are hereby incorporated by reference.

With such a system as that disclosed in FIGS. 1 and 2, following the first image exposure, successive color images are precisely aligned (registered) in the process and cross-process directions so that the start of exposure line for each frame is registered with previous start of exposure lines.

There are a number of prior art techniques for correcting the registration. For the system shown, and as disclosed in greater detail in the afore-referenced application Ser. No. 07/930,642, a target 30 is formed by adding a bit map data input to print bar 10A, via controller circuit 15, to expose a line image which is subsequently developed as target line 30 shown in FIG. 2. This line is formed in a non-image, interdocument area which precedes the leading edge (line of exposure 23) of image frame $l_1$ by several scan lines.

In a description of formation of a full color image; initially, a portion of belt 17 passes the charging station 18 which places the required charge on the surface of belt 10. As the belt advances into imaging station 10, the uniformly charged, photoconductive surface is exposed by print bar 10A which causes the charged portion of the belt to be discharged, first to form a latent image of the line mark and then a first black image, the image formed by creating a series of horizontal lines, each line having a certain number of pixels per inch at development station 26. At development station 26, a magnetic brush system, for example, advances the appropriate color development material, here black, into contact with the latent electrostatic image. The black developed latent image and the developed target line 30 continue to advance in the direction of arrow 24.

Charge station 19 recharges the photoconductive surface of belt 17 including the black developed frame. At second imaging station 12, a portion of print bar 12A is energized to provided a light output used to detect the passage of mark 30. Sensor 40 is located in a fixed position, relative to the underside of belt 17. The lighted portion of bar 12A faces sensor 40. Sensor 40, in a preferred embodiment, is a small PIN photodiode, which is sensitive to the wavelength of print bar 12A. The arrival of mark 30 is detected by turning on the print bar 12A to a level such that light can be detected by sensor 40 through the semi-transparent belt 17 for a window of time when the timing mark line is expected. The output of sensor 40 is sent to control circuit 15 which controls the operation of the print bar so as to initiate the start of scan exposure line for each image frame.

Figure 3:
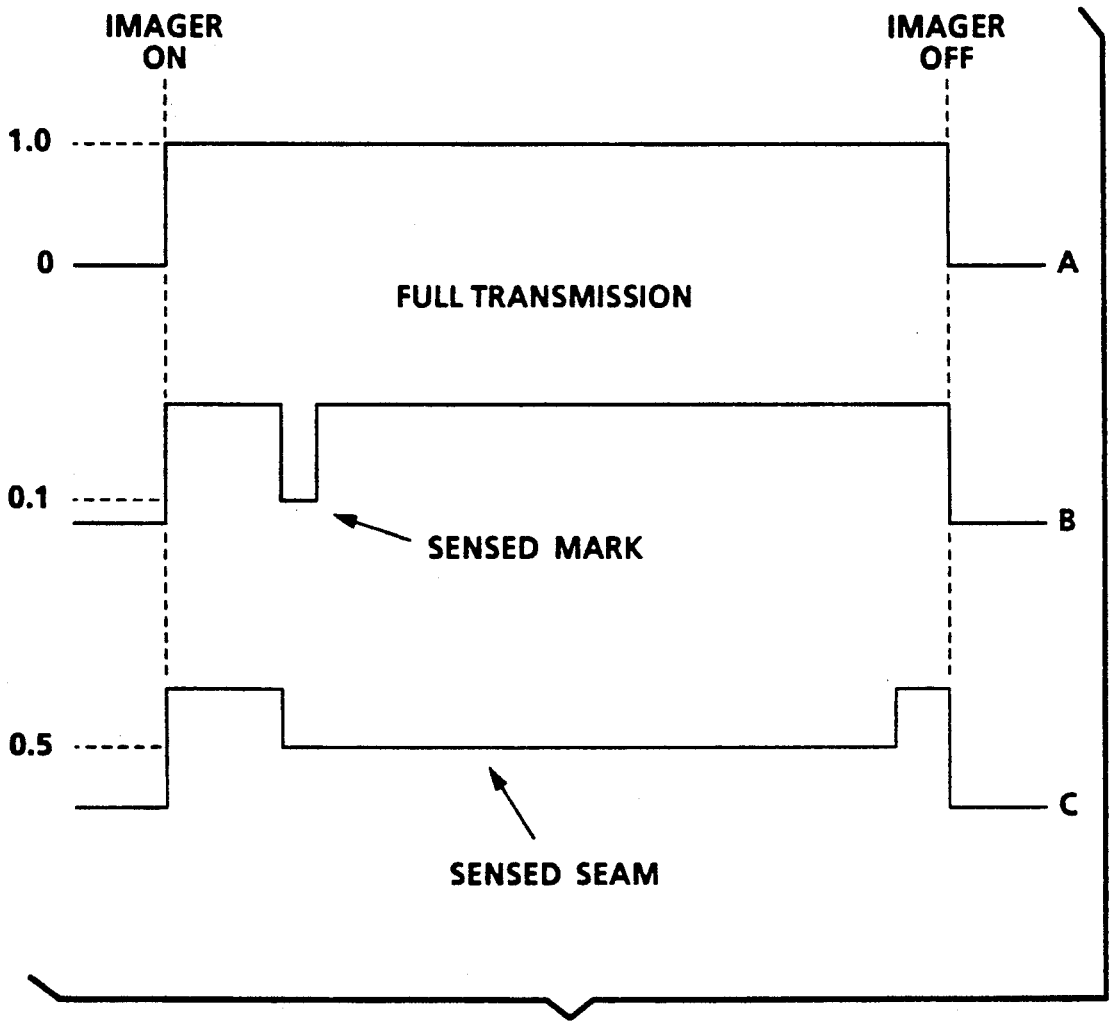
FIG. 3 shows outputs from a sensor which can be differentiated to indicate detection of the belt seam.

As referenced above, belt 18 is formed as part of the process of making the belt. With installation of each individual belt, an initial calibration is performed which identifies the seam location and sets the image frames to be outside of the seam. While the initial location of the seam vis a vis the exposure frames $l_1$–$l_4$ is known, over operation changes in the belt speed may move the images formed to a location which could intrude upon the seam, resulting in a defect to output copies. According to a first aspect of the invention, one of the sensors 40, 42, 44, could also be used to detect the passage in position of seam 18. For example, sensor 40, besides detecting mark 30, can also serve a second function and can detect passage of the belt seam as the belt, once each revolution, moves the seam therepast. An output signal distinct from the signal generated when the target is sensed will be generated. During initial calibration, the sensor 40 detects the passage of seam 30 and the output waveform, which contains information on seam width and density, is sent to circuit 50. FIG. 3 shows three representative output waveforms of sensor 40, waveform A being the output when neither a mark nor seam is detected; waveform B being the signal when a mark is detected and waveform C being the waveform signal output when the seam is detected. As is evident, the seam output is sufficiently different in magnitude and shape from the other outputs so as to be easily identified in a discrimination circuit 50, which sends an appropriate signal to controller circuit 15. Circuit 15 uses the signal to control the operation of the imagers to ensure that an image is not formed across the seam. Seam detection circuit 50 can sense both signal magnitude and signal duration. The magnitude of the toner mark signal, for this example, is approximately 10%, or less, of the full transmission magnitude. The seam signal is shown as about 50% of the full transmission magnitude and with a greater width than the toner signal. The signal duration of the toner mark will be less than 1 milli sec (based on, for example, a process velocity of 300 mm/sec, and width of the toner mark of 0.2 mm) while the seam signal duration can be greater than 10 milli sec. It is understood that the seam density and width may have other characteristics relative to the toner mark, for example, greater density and a shorter width. Circuit 50 compares the input signal and identifies it as the previously stored seam signal. Circuit 50 then digitizes the input signal from the sensor and produces an output signal pulse which is at the center of the detected seam signal.

Figure 4:
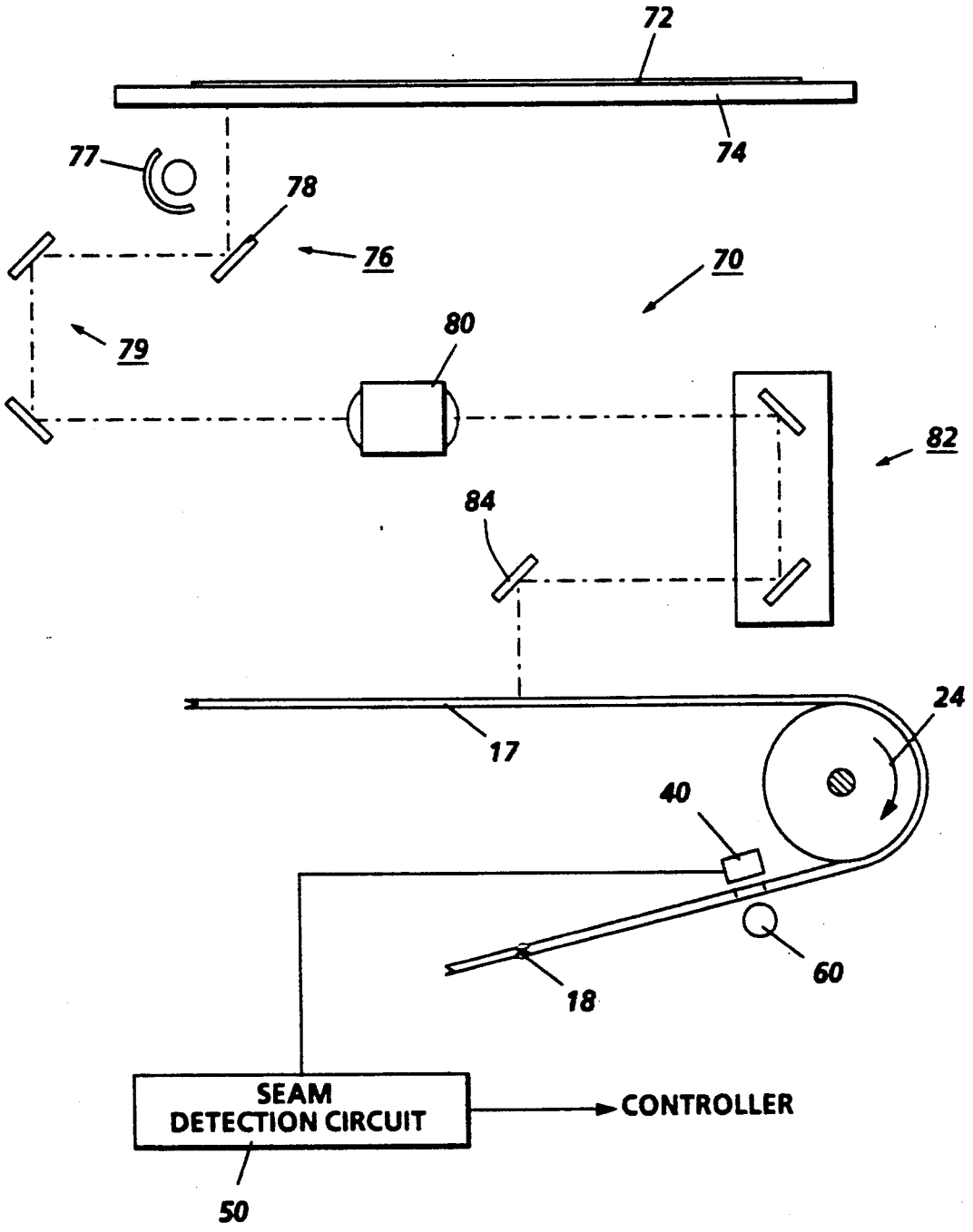
FIG. 4 is a side view of a light lens scanning system incorporating the seam detection circuitry of the present invention.

Although the invention has been described in the context of an LED print bar imager as the light source, it is understood that other imagers may be used such as, for example, a gas discharge or LCD shutter image bar, or a Raster Output Scanner (ROS). Further, for some systems, a dedicated light source may be used in conjunction with a sensor dedicated solely to viewing the seam passing one per revolution and generating a single pulse. The light source would be energized for a time interval during which seam passage is assured. FIG. 4 shows a light lens scanning system 70 wherein a document 72 placed on platen 74 is scanned by a scan assembly 76. Scan assembly 76 comprises a lamp 77, full rate mirror 78 and a one half rate mirror 79. The reflected line images are projected by lens 80 and folded by mirror assembly 82 and belt mirror 84 to form the latent image of the document on belt 17. The latent image is developed, transferred and fused by conventional xerographic techniques. Seam 18 on belt 17 is detected when it passes between a dedicated lamp source 60 and sensor 40. Output signals from sensor 40 are sent to seam detection circuit 50 where belt signals are identified as such and sent to the controller.

Other modifications of the present invention may occur to those skilled in the art based upon a reading of the present disclosure and these modifications are intended to be included within the scope of the present invention.

We claim:

1. An improved reproduction machine of the type having a light transmissive photoreceptor belt mounted for movement substantially in a predetermined reference direction, said belt having a seam extending across the width thereof, wherein the improvement comprises:

an imager opposed from one surface of the belt for sequentially exposing portions of the belt surface to form a image thereof, and at least one light sensitive sensor opposed from the other surface of the belt for sensing passage of the seam between the imager and the sensor, and for generating an output signal representative of said seam detection.

2. The machine of claim 1 further including control means responsive to said sensor output signal for adjusting said imager to expose said belt surface only in non-seam areas.

3. A method of detecting a seam on a light transmissive photoreceptor belt comprising the steps of:

positioning a stationary light source opposed from one surface of the belt for illuminating a portion of the belt outside of an imageforming area, positioning a light sensitive sensor opposed from the other surface of the belt for sensing the passing of the seam between the light source and the sensor, moving the belt so as to periodically move said seam between said light source and said sensor, and generating a signal upon detection of the belt seam.

4. In an imaging system for forming multiple image exposure frames on a light transmissive phototreceptor belt having a seam extending across the width thereof, said system including:

a photoreceptor belt adapted to accommodate the formation of an integral number of image exposure frames, said belt having at least one registration mark associated with at least one image frame, said mark located outside of the exposure frame, at least one LED print bar associated with the formation of one of said image exposure frames, each said one print bar having a central portion of light emitting pixels which are selectively activated to form said image exposure frames and an end portion of light emitting pixels outside of said exposure area which are activated for print bar registration and seam detection purposes, detecting means associated with said end portion and on the opposite side of the belt, said detecting means generating a first set of output signals when said registration marks pass between said end portion and detecting means and a second set of output signals when said belt seam passes between the end portion and the detecting means, and control means for comparing said first and second set of output signals and generating at least a seam identification signal upon detecting a second output signal associated with passage of the belt seam.

* * * * *